United States Patent [19]

Kipp et al.

[11] Patent Number: 4,960,306

[45] Date of Patent: Oct. 2, 1990

[54] OPEN-CUT MINING CUTTER

[75] Inventors: Thorwald Kipp; Bernhard Wiechers, both of Bad Oeynhausen, Fed. Rep. of Germany

[73] Assignee: O&K Orenstein & Koppel Aktiengesellschaft, Dortmund, Fed. Rep. of Germany

[21] Appl. No.: 272,750

[22] PCT Filed: Apr. 4, 1987

[86] PCT No.: PCT/EP87/00185

§ 371 Date: Oct. 7, 1988

§ 102(e) Date: Oct. 7, 1988

[87] PCT Pub. No.: WO87/06301

PCT Pub. Date: Oct. 22, 1987

[30] Foreign Application Priority Data

Apr. 7, 1986 [DE] Fed. Rep. of Germany ..... 3611580
Jun. 25, 1986 [DE] Fed. Rep. of Germany ..... 3621420

[51] Int. Cl.[5] ..... E21C 47/00

[52] U.S. Cl. ..... 299/41; 37/190; 37/DIG. 16; 299/68; 299/87

[58] Field of Search ..... 299/39, 41, 64, 68, 299/78, 85, 87; 37/189, 190, DIG. 16, 91, 92, 94, 95

[56] References Cited

U.S. PATENT DOCUMENTS

| | | | |
|---|---|---|---|
| 2,595,398 | 5/1952 | Lewis | 37/190 X |
| 2,851,143 | 9/1958 | Rosetz | 37/190 |
| 3,219,390 | 11/1965 | Conner | 299/41 X |
| 3,472,555 | 10/1969 | Theermann et al. | 299/41 |
| 4,312,541 | 1/1982 | Spurgeon | 299/31 |
| 4,486,050 | 12/1984 | Snyder | 299/18 |

FOREIGN PATENT DOCUMENTS

| | | | |
|---|---|---|---|
| 46927 | 8/1985 | Australia . | |
| 1039292 | 10/1953 | France . | |
| 1158143 | 6/1958 | France | 37/190 |
| 489581 | 7/1938 | United Kingdom | 299/39 |
| 740086 | 11/1955 | United Kingdom | 37/DIG. 16 |

OTHER PUBLICATIONS

PHW C-Miner for continuous Mining . . . , 11-1985.
Durst W. et al., Anlagen und Geräte in Tagebau, 1986, p. 131.12.
Cohrs, H. H., Kontinuierlich Arbeitende Abbau-und Lademaschinen (1983) pp. 161-165.
Hoffman, W. C., Surface Miner für den Tagebau, (1984), pp. 371-376.

*Primary Examiner*—Bruce M. Kisliuk
*Assistant Examiner*—David J. Bagnell
*Attorney, Agent, or Firm*—Spencer & Frank

[57] ABSTRACT

The present invention provides a crawler unit having a superstructure and a substructure and an excavating device for recovering bulk material. The excavating device has bearing regions and drive regions and also has vertically arranged shearing drums for cutting free the bearing and drive regions. The shearing drums have upper ends which are inclined obliquely forward.

13 Claims, 2 Drawing Sheets

OPEN-CUT MINING CUTTER

BACKGROUND OF THE INVENTION

1. Field of the Invention

The invention relates to an open-cut mining cutter, particularly for the mining of hard minerals as well as solidified overburden and muck layers. This kind of cutter has a crawler unit including a superstructure and a substructure, a excavating device followed by and a conveyor for the recovered bulk material.

2. Description of the Related Art

Essentially three types of open-cut mining cutters are known and in practical use. These are described, for example, in two technical journals: "Bergbau" [Mining], 8/84, pages 371–376, and "Fordern und Lademaschinen" [Conveying and Lifting] 33 (1983) No. 3, pages 161–165.

One type of cutter are so-called partial cut machines which operate with one or a plurality of rotating cutting heads of relatively small dimensions attached to cantilever arms which can be pivoted up and down as well as sideways. These machines are generally stationary during operation, particularly when used on higher work faces. The recovered material drops onto a loading ramp on the ground and is pulled onto a centrally disposed scraper chain conveyor by means of loading devices such as, for example, lobster claw loaders. The drawback of such devices operating with discontinuous feed is, in particular, their relatively low, greatly fluctuating yield which also depends, inter alia, on the skill and excavating strategy of the operator. The grain size of the bulk material is also subject to great fluctuations and oversizes are difficult to avoid and can only be avoided at the expense of lower yield. Another drawback is the narrow working width compared to the working height — particularly as a result of the loading device involved — and the sensitive and wear subjected conveying member, the scraper chain.

A second type of cutter are so-called continuous miners which have a shearing drum arranged transversely between the front and rear crawlers. The drum equipped with helically arranged digging members operates in a rearward-downward direction of rotation. The loosened material is thus pushed to the middle and over a flat loading shield onto the discharge conveyor. The drawbacks of such devices are their limited working width and their low working depth as a result of the absence of the possibility of making a free cut in the region of the drum bearing. Such excavating devices are also not suitable for working hard minerals from thicker layers since the picks are unable to cut themselves free in the working region at the fast rate of advancement and with the circumferential velocity directed in the opposite direction. Further drawbacks are the incomplete transport of the loosened material toward the center and the loading process by way of the loading shield which is connected with great expenditures of force and with wear.

A third type of cutter, so-called surface miners of similar construction as the above-described continuous miners. In contrast to the latter, whose working principle is practically a digging process, these are true cutters. The direction of rotation of the drums equipped with helically arranged picks is forward-upward, i.e. the loosened material must be thrown over and beyond the drum onto the discharge conveyor. In addition to the helical pick arrangement, the drum is provided with gripper strips for this loading process as well as with deflecting walls in front of and above the drum and finally with a shield which pushes the material that has dropped behind the drum over the ground until the drum grips it again. The drawback here is that extensive grain comminution takes place during loosening as well as loading. Similarly to the continuous miners, this type of structure is also able to produce only a relatively small working depth and width. Therefore, high excavating yields necessitate long paths and high processing speeds. This involves not only correspondingly high costs for energy, wear and maintenance but also for the further transport of the recovered material on trucks. Moreover, the marginal conditions of open-cut mining operations are established thereby and in many cases these cannot be combined with economical work planning.

Also known is another open-cut mining cutter which, however, has not yet been constructed ("Schaufelradbagger" [Bucket Wheel Excavator]by W. Durst and W. Vogt, Trans Tech Publications, 1986, page 131.12). The concept of the so-called C-miner is such that the drawbacks of the prior art open-cut mining cutters are avoided and it becomes possible to integrate the device in a continuously operating excavating and transporting system. The excavating device is a three-part trench-cutting drum arranged horizontally at the head. The helically arranged picks of the fast rotating trench-cutting drums are also suitable, just like those of the above-described surface miners, for loosening hard minerals and are supported in the conveying direction by a wear-resistant, double helix on the drum to convey the loosened material from both sides toward the middle Due to the partial overlap of the cutting ranges of the center drum and the side drums, which are arranged at a forward angle, the bearing and drive regions are cut free. In conjunction with the rearward-downward cutting action, this makes possible working heights which lie above the drum diameter. The simultaneous loosening and loading over the entire width of the drum results in quiet operation and uniform comminution of the recovered bulk material to a size which can be transported on a conveyor belt. The arrangement of the excavating device in front of the crawler unit in conjunction with the transport of the material by the helixes and a guide plate or shield arranged vertically behind the drum permits a greater working width than do the above-described open-cut mining cutters. The recovered bulk material is accumulated behind the center drum and is intended to pass through a high passage opening in the center of the shield onto the conveyor belt disposed behind it. This loading principle requires at least very high pushing forces and is encumbered by unsatisfactory efficiency. A further drawback of the C-miner is its limited ability to work thin, hard layers. Due to the rearward-downward direction of rotation, such cases will require the force of a very great weight to prevent the machine from "climbing". As for the other open-cut mining cutters, greater percentages of cohesive material will make recovery even more difficult or impossible since the helixes are clogged by baked-on material and are practically impossible to clean.

SUMMARY OF THE INVENTION

It is the object of the invention to improve an open-cut mining cutter. The present invention includes a crawler unit having a superstructure and a substructure and an excavating device for recovering bulk material. The excavating device has bearing regions and drive regions and also has vertically arranged shearing drums for cutting free the bearing and drive regions. The shearing drums have upper ends which are inclined obliquely forward. Using the present invention's cutter continuous loosening and loading is possible in one process phase and the recovered bulk material may be transferred directly to a continuous conveyor system. The drawbacks of the prior art open-cut mining cutters are avoided thereby and high yields are realized in the excavating of hard minerals and thin layers.

This is accomplished by the invention in that the bearing and drive regions of the excavating device can be cut free by approximately vertically arranged shearing drums whose upper ends are inclined obliquely forward. Open-cut mining cutters operating in the forward-upward mode as well as those operating in the rearward-downward mode all have advantages and disadvantages. The present invention combines the advantages of both excavating principles and simultaneously avoids their drawbacks which result primarily from the multiple functions of the shearing drums.

The excavating device according to the invention is preferably composed of at least one pair of oppositely rotating, parallel shearing drums which, in order to cut free the lower bearing regions, have their upper drum ends inclined obliquely forward and are arranged in front of the crawler unit. This results in the following advantages over the prior art:

The picks move on approximately horizontal cutting circles so that no noticeable vertical forces are generated and, in particular, "climbing" of the machine is avoided. Moreover, the cutting forces are minimized since the picks are able to penetrate more easily into the solid material of the layer of materials to be mined when the picks are in the $\omega$ approximately horizontal $\omega$ plane. The approximately vertical arrangement of the shearing cutters also makes possible the construction of excavating devices which are able to work at great heights without having to have correspondingly large drum diameters or performing alternatingly traveling and pivoting movements as do the partial-cut machines.

For cases where predominantly thin layers are to be mined over a wide width, the invention is provides an alternative excavating device composed of at least one horizontally mounted shearing drum which is arranged transversely in front of the crawler unit and whose bearing and drive regions can each be cut free by an approximately vertically disposed shearing drum whose upper end is inclined obliquely forward. The thus realizable wide working width with simultaneously high excavation height permits high yields at low advancing speeds and driving power (path traversed). Additionally, the horizontal arrangement of the excavating device produces a planar surface and it becomes possible to accurately mine individual layers.

In the approximately vertical arrangement of the excavating device each shearing drum is preferably composed of a plurality of individual ring elements equipped with picks and arranged concentrically on a common drive shaft. This facilitates manufacture and spare parts warehousing as well as the exchange of worn shearing drums and makes the system more economical.

In dependence on the type of material to be worked, it is necessary or desired in many cases to produce certain average or maximum grain sizes in the recovered bulk material. For this purpose, the vertical arrangement of the excavating device provides the possibility, on the one hand, to employ differently dimensioned ring elements or ring elements equipped with picks or, alternatively, by changing the axial spacing, to set the gap width between the shearing drums to the desired dimension.

For the same purpose it is proposed, according to a further idea of the invention, to arrange the picks of the individual shearing drums axially or circumferentially offset so that the cutting ranges of the shearing drums overlap in part.

In the approximately vertical arrangement of the excavating device, guide plates are provided in the rear region of the shearing drums. Thus, most of the recovered bulk material comes directly into the loading range of the conveyor, while the rotating picks return the remainder to the front into the cutting region through the concentric gap formed between the guide sheet and the shearing drum.

For wide working widths, excavating devices are employed which have a plurality of approximately vertically arranged pairs of shearing drums or horizontally arranged shearing drums. In these cases, the recovered bulk material is transported to the center of the device by worm conveyors provided on its left and right and arranged immediately following the excavating device. If necessary, the worm conveyors may also be equipped with picks in order to cut off projecting remainders and thus produce a clean ground surface.

To pick up the bulk material from the surface and load it onto a higher disposed conveyor belt, the invention provides a belt-type bucket elevator or, alternatively, a rotary vane feeder. The rotary vane feeder, which is open at the front, rotates about the center support of the superstructure and is sealed, except for its loading and discharge region, against inadvertent discharge by stationary chute walls. Rotary vane feeding is suitable for the most varied types of materials and permits lifting to large heights over short distances, thus resulting in a compact structure of the excavating device and an advantageously large drop height for the discharge conveyor belt.

According to the invention, the excavating and conveying devices of the open-cut mining cutter are arranged at or on a superstructure which is mounted so as to be movable in all directions. The pivot bearing in the middle or rear region of the crawler unit in the center between the crawlers makes it possible to raise and lower the superstructure which is vertically supported on the front crawler axis by means of a hydraulic cylinder on each side. The superstructure is also connected with the crawler unit by means of a guide cylinder arranged horizontally in the region of the front crawler axis. The guide cylinder also pivots the superstructure to either side and incline it. Thus it is possible not only to work selectively even if the layer is sloped, but also to improve maneuverability and free cutting, for example, in connection with steep* and ramp cuts.

*Translator's note: The original German word "Stallschnitt" which is untranslatable is assumed to be "Steilschnitt" and has been translated as such.

The separation, according to the invention, of the functions loosening/breaking and transporting permits the shearing drums to be equipped with picks in such an arrangement that the drums can be cleaned by means of radially adjustable rakes. Thus it becomes possible to work layers containing a larger percentage of cohesive material without the shearing drums clogging.

BRIEF DESCRIPTION OF THE DRAWINGS

Exemplary uses of the idea of the invention are illustrated in drawing FIGS. 1 to 5 which depict two open-cut mining cutters and will be described below.

DESCRIPTION OF THE PREFERRED EMBODIMENTS

Figure 1:
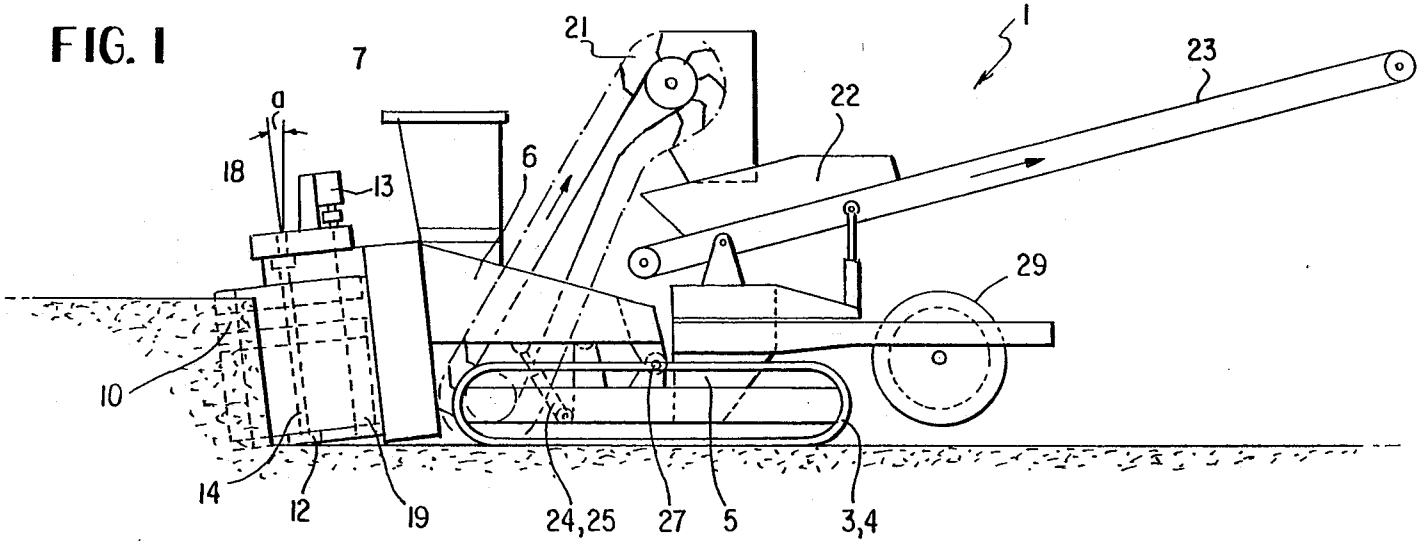
FIGS. 1 and 2 are two views of an open-cut mining cutter equipped with an approximately vertically arranged pair of shearing drums.
Figure 2:
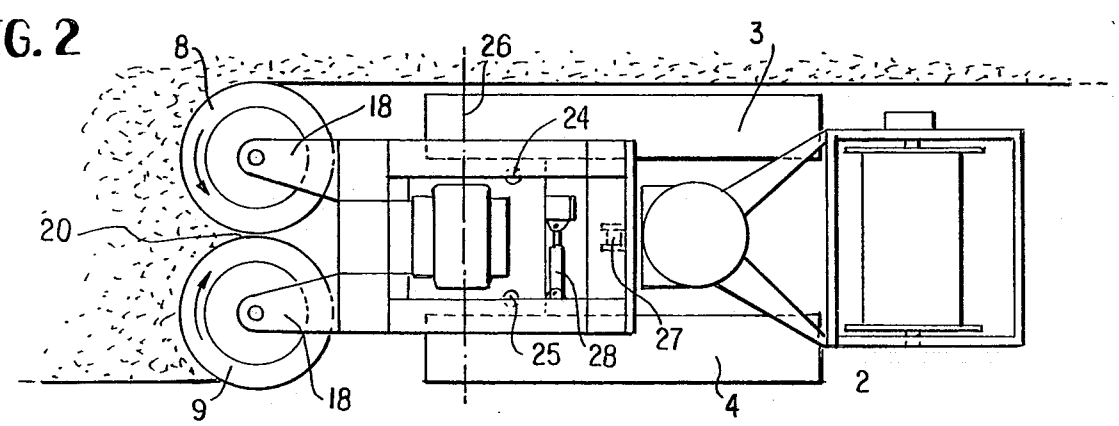

FIGS. 1 and 2 show an open-cut mining cutter 1 comprising the following component groups: a crawler unit 2 having two crawlers 3 and 4, a substructure 5 and a superstructure 6 as well as an excavating device 7 and conveying devices 21, 22 and 23. Substructure 5 is rigidly connected with crawler unit 2 and supports a frame for a cable drum 29 and, on the other hand, a pivotal discharge conveyor belt 23 which can be raised and lowered. Superstructure 6 which carries the excavating device 7 and a belt-type bucket elevator 21, is mounted by means of swivel bearings 27 so as to be movable in all directions. The superstructure 6 is mounted in the center region of crawler unit 2 in between crawlers 3 and 4 and is supported on each side approximately vertically on the front crawler axis 26 by hydraulic cylinders 24 and 25. The superstructure 6 can be raised and lowered as well as pivoted to either side and inclined and is connected with crawler unit 2 by means of a guide cylinder 28 arranged approximately horizontally in the region of front crawler axis 26. The excavating device 7 is composed of an approximately vertically arranged pair of oppositely rotating, parallel shearing drums 8 and 9 whose upper ends are inclined forward at an angle so as to cut free the lower bearing regions 12. Each shearing drum 8 and 9 is composed of a plurality of individual ring elements 10 equipped with picks and arranged concentrically on a common drive shaft 14. Drive shafts 14 are mounted in the upper and lower jaws 18 and 19 of the drum frame. Vertical forces are absorbed only by the upper jaws 18 on which drive assemblies 13 are also disposed.

Figure 3:
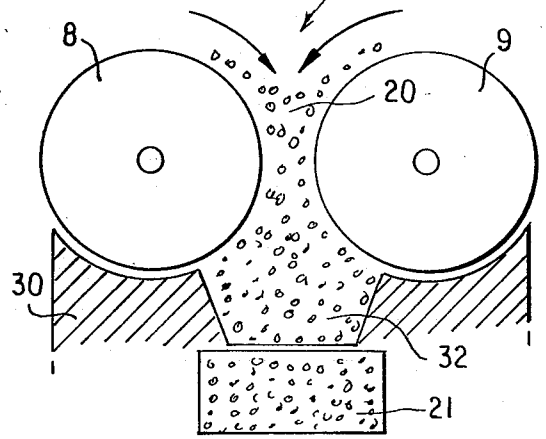
FIG. 3 is a basic sketch of the excavating device of FIGS. 1 and 2.

FIG. 3 is a plan view of excavating device 7 and the loading region of belt-type bucket elevator 21. The recovered bulk material passes through a gap 20 between shearing drums 8 and 9 into loading region 32 which is delimited by lateral chute walls and the belt-type bucket elevator 21 disposed behind it between crawlers 3 and 4. A small portion of the bulk material is returned to the cutting region by shearing drums 8 and 9, which has a rear region covered by guide sheets 30.

Figure 4:
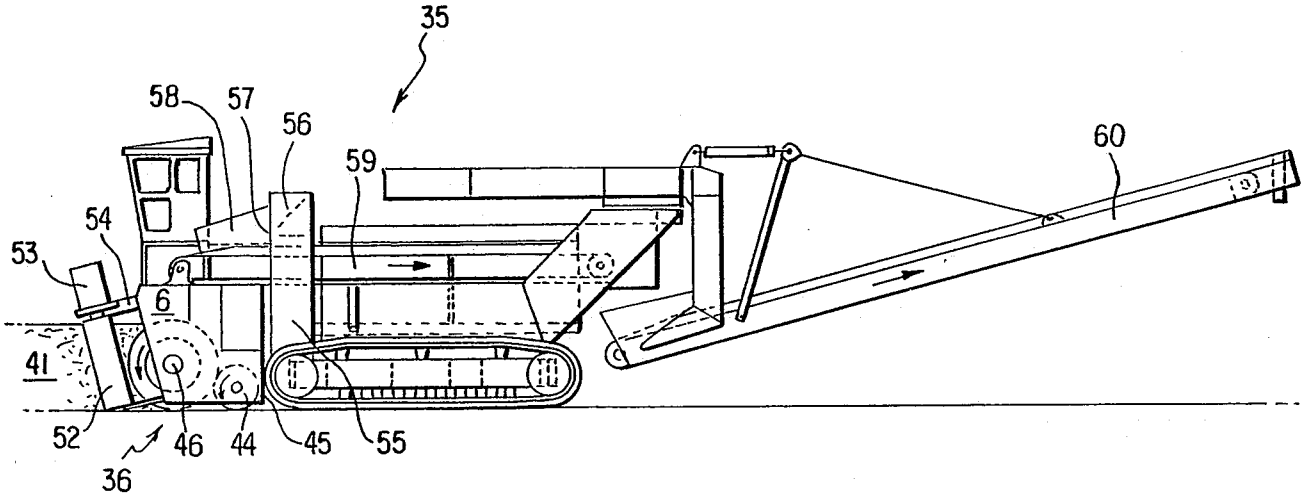
FIGS. 4 and 5 are two views of an open-cut mining cutter equipped with a horizontally arranged excavating device.
Figure 5:
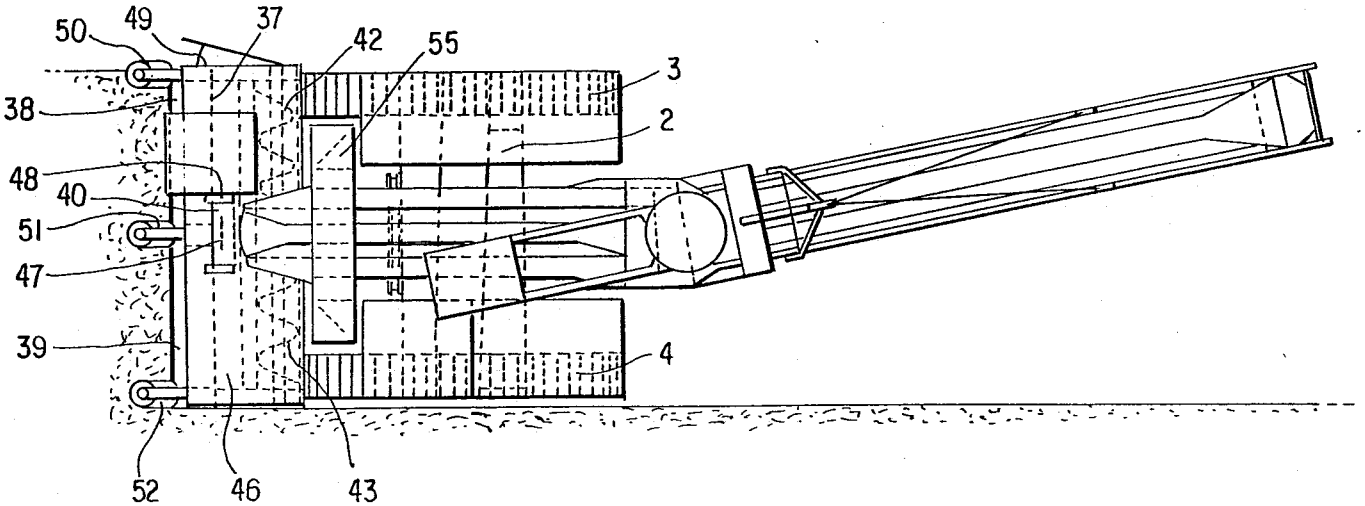

FIGS. 4 and 5 show an alternative embodiment of the invention, an open-cut mining cutter 35. Component groups which are identical to those employed in connection with the above-described open-cut mining cutter 1 are given the same reference numerals as in FIGS. 1 to 3.

The open-cut mining cutter 35 also includes a crawler unit 2 having two crawlers 3 and 4 and a superstructure 6 movable to all sides. Similarly to the open-cut mining cutter 1, in this embodiment the superstructure 6 is mounted on crawler unit 2 and supports a an excavating device 36 as well as all conveying devices 42, 43, 55, 59 and 60. The excavating device 36 is composed of two horizontally mounted shearing drums 38 and 39 arranged transversely in front of crawler unit 2 and having a flush longitudinal axis 37. The bearing and drive regions 47, 48 and 49 are each cut free by a shearing drum 50, 51 or 52 disposed approximately vertically in front of the respective drive region, with the upper ends of the drums being inclined obliquely forward and their drive assembly 53 being disposed on an upper bearing bracket 54. For reasons of clarity, FIGS. 4 and 5 show no additional drive assemblies. The rearward-downward direction of rotation of shearing drums 38 and 39 causes the loosened bulk material to be pulled through the gap formed between the ground and shearing drums 38 and 39 and to be comminuted to a defined maximum grain size. The recovered bulk material is transported to the center of the device by worm conveyors 42 and 43 disposed on the left and right side immediately behind excavating device 36 and in front of a vertical shield 44. The bulk material accumulated in loading region 32 is picked up laterally by a rotary vane feeder 55 which rotates around the central support superstructure 6 and is discharged into the feed chute 58 of a conveyor belt 59 disposed at the top of superstructure 6. From there the material is transferred to a discharge conveyor belt 60 which can be raised, lowered and pivoted to the side. Charging of rotary vane feeder 55 is facilitated by a loading ramp 45 which lies on the ground in front of the feeder in loading region 32. Except for the charging and discharging region, the cell buckets 56, which are open on one side, are sealed against inadvertent emptying by stationary chute walls 57.

In the horizontally arranged excavating device 36 as well, the separation of the functions loosening/breaking and transporting makes it possible to arrange the picks in such a manner that axial gaps are produced between the picks (not shown) into which a radially adjustable rake (not shown) is able to engage so a to clean caked-on material out of shearing drums 38 and 39.

We claim:

1. Open-cut mining cutter comprising:

a crawler unit having a superstructure and a substructure;

an excavating device for recovering bulk material, said excavating device including bearing and drive regions;

approximately vertically arranged shearing drums for cutting free said bearing and drive regions, said shearing drums having upper ends inclined obliquely forward; and a conveying means for conveying bulk material from said excavating device, wherein said excavating device includes at least one horizontally mounted shearing drum arranged transversely in front of said crawler unit and having bearing and drive regions cut free by at least one of said approximately vertically disposed shearing drums.

2. The open-cut mining cutter according to claim 1, wherein said shearing drums have axes spaced from each other and said cutter further comprises an adjustable gap between said shearing drums, said gap being adjustable by changing the spacing of said axes of said shearing drums.

3. The open-cut mining cutter according to claim 1, wherein said shearing drums have picks thereon arranged axially with respect to one another and said shearing drums have partially overlapping cutting regions.

4. The open-cut mining cutter according to claim 1, wherein said shearing drums include a cutting region and a rear region covered by guide sheets whereby recovered bulk material is moved into a charging region of said conveying means and the remainder of the bulk material is returned into said cutting region.

5. The open-cut mining cutter according to claim 1, wherein said conveying means comprises worm conveyors disposed to the left and right immediately behind said excavating device.

6. The open-cut mining cutter according to claim 1, wherein said conveyor device comprises a belt-type bucket conveyor for receiving the recovered bulk material and lifting it to a conveyor belt disposed at a higher level.

7. The open-cut mining cutter according to claim 1, wherein said crawler unit includes a central region and crawlers; and said superstructure supports said excavating device and said conveying means, said superstructure:

being mounted by means of swivel bearings in said central region of said crawler unit between the crawlers, being movable up and down and laterally pivotable and tiltable, being vertically supported on each side on a front crawler axis by means of a hydraulic cylinder, and being connected with said crawler unit by means of a guide cylinder arranged horizontally in a region surrounding said front crawler axis.

8. The open-cut mining cutter according to claim 1, wherein aid mining cutter further comprises radially adjustable rakes for cleaning said shearing drums.

9. The open-cut mining cutter according to claim 1, wherein said shearing drums have picks thereon arranged circumferentially offset with respect to one another and have partially overlapping cutting regions.

10. The open-cut mining cutter according to claim 1, wherein said crawler unit includes a rear region and crawlers; and said superstructure supports said excavating device and said conveying means, said superstructure being mounted by means of swivel bearings in said rear region of said crawler unit between said crawlers, being movable up and down and laterally pivotable and tiltable, being vertically supported on each side on a front crawler axis by means of a hydraulic cylinder, and being connected with said crawler unit by means of a guide cylinder arranged horizontally in a region surrounding said front crawler axis.

11. Open-cut mining cutter comprising:

a crawler unit having a superstructure and a substructure;

an excavating device for recovering bulk material, said excavating device including bearing and drive regions;

approximately vertically arranged shearing drums for cutting free said bearing and drive regions, said shearing drums having upper ends inclined obliquely forward; and a conveying means for conveying bulk material from said excavating device, wherein each said shearing drum comprises a plurality of individual ring elements equipped with picks, said ring elements being arranged concentrically on a common drive shaft.

12. Open-cut mining cutter comprising:

a crawler unit having a superstructure and a substructure;

an excavating device for recovering bulk material, said excavating device including bearing and drive regions;

approximately vertically arranged shearing drums for cutting free said bearing and drive regions, said shearing drums having upper ends inclined obliquely forward; and a conveying means for conveying bulk material from said excavating device, wherein said conveying means comprises worm conveyors disposed to the left and right immediately behind said excavating device and said worm conveyors include picks for shearing off ground surface.

13. Open-cut mining cutter comprising:

a crawler unit having a superstructure and a substructure;

an excavating device for recovering bulk material, said excavating device including bearing and drive regions;

approximately vertically arranged shearing drums for cutting free said bearing and drive regions, said shearing drums having upper ends inclined obliquely forward; and a conveying means for conveying bulk material from said excavating device, wherein said mining cutter further comprises a loading region where bulk material is accumulated, a rotary vane feeder for laterally receiving bulk material from said loading region, said rotary vane feeder rotating about a central support of the superstructure (6) and cell buckets for discharging the bulk material into a charging chute (58) of a conveyor belt in a charging and discharging region disposed at the top of said central support, said cell buckets being open on one side and being sealed against inadvertent discharging, except in said charging and discharging region, by stationary chute walls.

* * * * *